US007896010B2

(12) United States Patent
Ishikawa et al.

(10) Patent No.: US 7,896,010 B2
(45) Date of Patent: Mar. 1, 2011

(54) FILTER CIGARETTE INSPECTION APPARATUS AND INSPECTION METHOD

(75) Inventors: Yoshiaki Ishikawa, Tokyo (JP); Shinzo Kida, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 991 days.

(21) Appl. No.: 11/268,504

(22) Filed: Nov. 8, 2005

(65) Prior Publication Data

US 2006/0037619 A1 Feb. 23, 2006

(51) Int. Cl.
*A24C 5/32* (2006.01)
*A24C 5/34* (2006.01)

(52) U.S. Cl. ..... 131/280; 131/904

(58) Field of Classification Search ..... 131/280, 131/904

See application file for complete search history.

(56) References Cited

U.S. PATENT DOCUMENTS 4,888,977 A 12/1989 Chehab et al.

FOREIGN PATENT DOCUMENTS

| | | | |
|---|---|---|---|
| JP | 56-31326 | | 8/1954 |
| JP | 50-105898 | Y2 | 8/1975 |
| JP | 1-309673 | A | 12/1989 |
| JP | 3190132 | B2 | 5/2001 |
| JP | 2002-58464 | A | 2/2002 |
| UA | 68 391 | C2 | 9/2001 |

*Primary Examiner*—Khanh Nguyen
*Assistant Examiner*—Matthew Hoover
(74) *Attorney, Agent, or Firm*—Birch, Stewart, Kolasch & Birch, LLP

(57) ABSTRACT

An inspection apparatus for a filter cigarette FT having a perforation line (6) in the outer circumferential surface of a filter (4) for introducing the outside air has a filter socket assembly (86) that is capable of receiving the filter (4) and includes a ring holder (124) defining in the inside an end chamber for surrounding the mouthpiece of the filter (4) and a surrounding chamber for surrounding the outer circumferential surface of the filter (4) including the perforation line (6), a guide pipe (102) for supplying a compressed fluid of the given pressure into the surrounding chamber of the ring holder (124), and a guide pipe (100) that outputs the pressure in the end chamber; and a pressure sensor for detecting the pressure outputted from the guide pipe (100) that outputs the pressure in the end chamber.

7 Claims, 9 Drawing Sheets

FILTER CIGARETTE INSPECTION APPARATUS AND INSPECTION METHOD

TECHNICAL FIELD

The present invention relates to a filter cigarette inspection apparatus and a filter cigarette inspection method for measurement of filter ventilation of filter cigarettes as rod-like articles.

BACKGROUND ART

The filter of a filter cigarette has a rod-like filter material and a wrapping material that envelops the filter material. One of the wrapping materials is a filter having a plurality of perforations. When the filter cigarette with a filter having perforations is smoked, air flows into the filter through the perforations, which dilutes smoke from the cigarette. As a result, nicotine and tar contained in the smoke are reduced, so that the smoker can enjoy a mild flavor.

The ratio of an air amount flowing in from the perforations to an amount of the smoke drawn by the smoker is called filter ventilation (hereinafter also simply referred to as $V_F$). As for the above-mentioned filter cigarettes, if $V_F$ is not fixed constant for each cigarette, the cigarettes do not have a uniform flavor and vary in their qualities.

The International Organization for Standardization defines a method of measuring $V_F$, which is carried out by a measurement standard. This measurement standard is used in manufacturing plants of filter cigarettes. More specifically, filter cigarettes are pulled out of the tobacco-manufacturing machine at a constant rate, and the $V_F$ of the pulled-out filter cigarettes is measured by the measurement standard. In short, only some of the manufactured filter cigarettes are subjected to the extraction and the inspection of $V_F$.

The method of measuring $V_F$, which is compliant with the ISO, however, is complicated because it is troublesome to install the measurement standard in the tobacco-manufacturing machine. Even if the measurement standard can be installed in the tobacco-manufacturing machine, it takes a lot of time to inspect the $V_F$ of each filter cigarette. Therefore, it is difficult to conduct the inspection of all the manufactured filter cigarettes by this measuring method.

The measurement standard is also used in the inspection of undesired holes made in wrapping paper. As to a filter cigarette having great $V_F$, however, an air amount flowing in through perforations is relatively greater than the air amount flowing in through the holes made in the wrapping paper. This makes it difficult to detect the holes made in the wrapping paper without fail by using the measurement standard.

The tobacco-manufacturing machine disclosed in Japanese Patent No. 3190132 has an inspection apparatus for inspecting not $V_F$ but total ventilation (hereinafter also simply referred to as $V_T$) as a control index for a nicotine and tar amount. The $V_T$ is the ratio of an air amount flowing in from the perforations of wrapping paper and filter of the cigarette to an amount of the smoke drawn by the smoker.

However, this well-known inspection apparatus is not capable of directly inspecting the $V_F$, and not capable of credibly control the nicotine and tar amount of filter cigarettes.

DISCLOSURE OF THE INVENTION

An object of the present invention is to provide a new inspection apparatus and a new inspection method capable of measuring filter ventilation of filter cigarettes in a short time.

Another object of the present invention is to provide a new inspection apparatus and a new inspection method capable of reliably detecting the formation of undesired holes in wrapping paper.

To achieve the objects, according to the present invention, an inspection apparatus for a filter cigarette having a cigarette, a filter that is connected to the cigarette and has a mouthpiece end, and a ventilation area in an outer circumferential surface of the filter for introducing outside air includes a transport path that transports the filter cigarette in a direction orthogonal to an axial direction of the filter cigarette and has an inspection position interposed therein; a filter socket assembly that is disposed on one side of the transport path and is allowed to be connected to the filter cigarette when the filter cigarette passes through the inspection position, the filter socket assembly including a socket that is capable of receiving the filter and defines in the inside thereof a first airtight chamber for enclosing the mouthpiece end of the filter and a second airtight chamber for enclosing the outer circumferential surface of the filter including the ventilation area, a lateral input path for supplying the second airtight chamber of the socket with a compressed fluid of a given pressure, and an output path that outputs a pressure in the first airtight chamber; and a pressure sensor for detecting the pressure outputted from the output path.

According to the above-described inspection apparatus, it is possible to inspect filter cigarettes in a transporting process thereof and to find $V_F$ per se, namely the ratio of an air amount flowing in from an outer circumferential surface of the filter to a drawing amount of the smoker. It is also possible to find the $V_F$ on the basis of the given pressure at which the second airtight chamber is supplied with the compressed fluid and the pressure detected by the pressure sensor, which enables a quick inspection. Consequently, the inspection apparatus makes it possible to carry out effective on-machine control on the $V_F$ of each filter cigarette, and to reliably control a nicotine and tar amount in the filter cigarette.

According to a specific aspect, the inspection apparatus further has reciprocating means that reciprocates the filter socket assembly toward the filter cigarette in order to receive the filter in the socket removably. In the above-mentioned structure, the cigarette socket assembly includes the pair of seal rings disposed in the socket to be separated from each other in the axial direction and to be reducible in diameters. The seal rings come into tight contact with the filter when reduced in diameters, thereby partitioning the first and second airtight chambers.

In the above-described structure, it is preferable that the seal rings be formed of elastically deformable rubber rings, and that the cigarette socket assembly include compression means that is actuated by operating the reciprocating means as a drive source and compresses each of the rubber rings to reduce the diameters thereof.

With this structure, the first and second airtight chambers can be formed by using one reciprocating means. Furthermore, since the elastically deformable rubber rings are brought into tight contact with the filter part, the compressed fluid and air are prevented from leaking from between the filter part and the seal rings partitioning the first and second airtight chambers. Consequently, a first pressure sensor is capable of detecting the pressure in the first airtight chamber with accuracy when the second airtight chamber is supplied with the compressed fluid of the given pressure. In other words, it is possible to upgrade reliability of control on the $V_F$ of filter cigarettes, that is, nicotine and tar, with the simple structure.

As a preferred aspect, the inspection apparatus further has a cigarette socket assembly that is disposed on the other side of the transport path and is allowed to be connected to the filter cigarette when the filter cigarette passes through the inspection position, the cigarette socket assembly including a cigarette socket that is capable of receiving a tip end of the cigarette and defines a third airtight chamber for enclosing the tip end of the cigarette in the inside thereof, and a forward input path for supplying the third airtight chamber of the cigarette socket with a compressed fluid of a given pressure when the second airtight chamber is in a fluidically closed state, the apparatus in which the lateral input path of the filter cigarette assembly is blocked off while the third airtight chamber is supplied with the compressed fluid.

With this structure, it is possible to detect not only the $V_F$ of filter cigarettes but also the formation of undesired holes in wrapping paper in the transporting process of the cigarettes on the basis of the pressure detected by the pressure sensor. In this case, since the second airtight chamber is closed, the formation of holes can be detected without fail regardless of the level of $V_F$ of the filter cigarettes. As a result, defective filter cigarettes can be surely removed.

As a specific aspect, the inspection apparatus further has a rotatable drum provided with each of the socket assemblies and including an outer circumferential surface defining the transport path.

In order to accomplish the above-mentioned objects, an inspection method for a filter cigarette including a cigarette, a filter that is connected to the cigarette and has a mouthpiece end, and a ventilation area in an outer circumferential surface of the filter for introducing outside air includes the steps of forming a first airtight chamber for enclosing the mouthpiece end of the filter, forming a second airtight chamber for enclosing the outer circumferential surface of the filter including the ventilation area, and measuring a pressure in the first airtight chamber when the second airtight chamber is supplied with a compressed fluid of a given pressure.

According to the inspection method, it is possible to directly find the $V_F$ per se, namely the ratio of an air amount flowing in from the outer circumferential surface of the filter to a drawing amount of the smoker. Since the $V_F$ is found on the basis of the given pressure at which the compressed fluid is supplied into the second airtight chamber and the pressure detected by the first pressure sensor, the inspection can be quickly carried out.

To be specific, the inspection method is carried out in a process where the filter cigarette is transported in a direction orthogonal to an axial direction thereof.

According to the inspection method, it is possible to quickly inspect each of the filter cigarettes, so that the filter cigarettes can be inspected in the transporting process. Therefore, the inspection method makes it possible to carry out effective on-machine control on the $V_F$ of all the filter cigarettes, realizing reliable control on the nicotine and tar amount in the filter cigarettes.

Furthermore, to achieve the above-mentioned object, an inspection method for a filter cigarette having a cigarette, a filter that is connected to the cigarette and has a mouthpiece end, and a ventilation area in an outer circumferential surface of the filter for introducing outside air includes the steps of forming a first airtight chamber for enclosing the mouthpiece end of the filter, forming a second airtight chamber for enclosing the outer circumferential surface of the filter including the ventilation area, forming a third airtight chamber for enclosing a tip end of the cigarette, and measuring a pressure in the first airtight chamber when the third airtight chamber is supplied with a compressed fluid of a given pressure.

To be concrete, the inspection method is carried out in a process where the filter cigarette is transported in a direction orthogonal to an axial direction thereof.

The inspection method makes it possible to detect the formation of undesired holes in the wrapping paper of the filter cigarettes on the basis of the pressure detected by the pressure sensor. Moreover, since the second airtight chamber is closed, it is also possible to detect the formation of the holes without fail regardless of the level of $V_F$ of the filter cigarettes.

BEST MODE OF CARRYING OUT THE INVENTION

Figure 1:
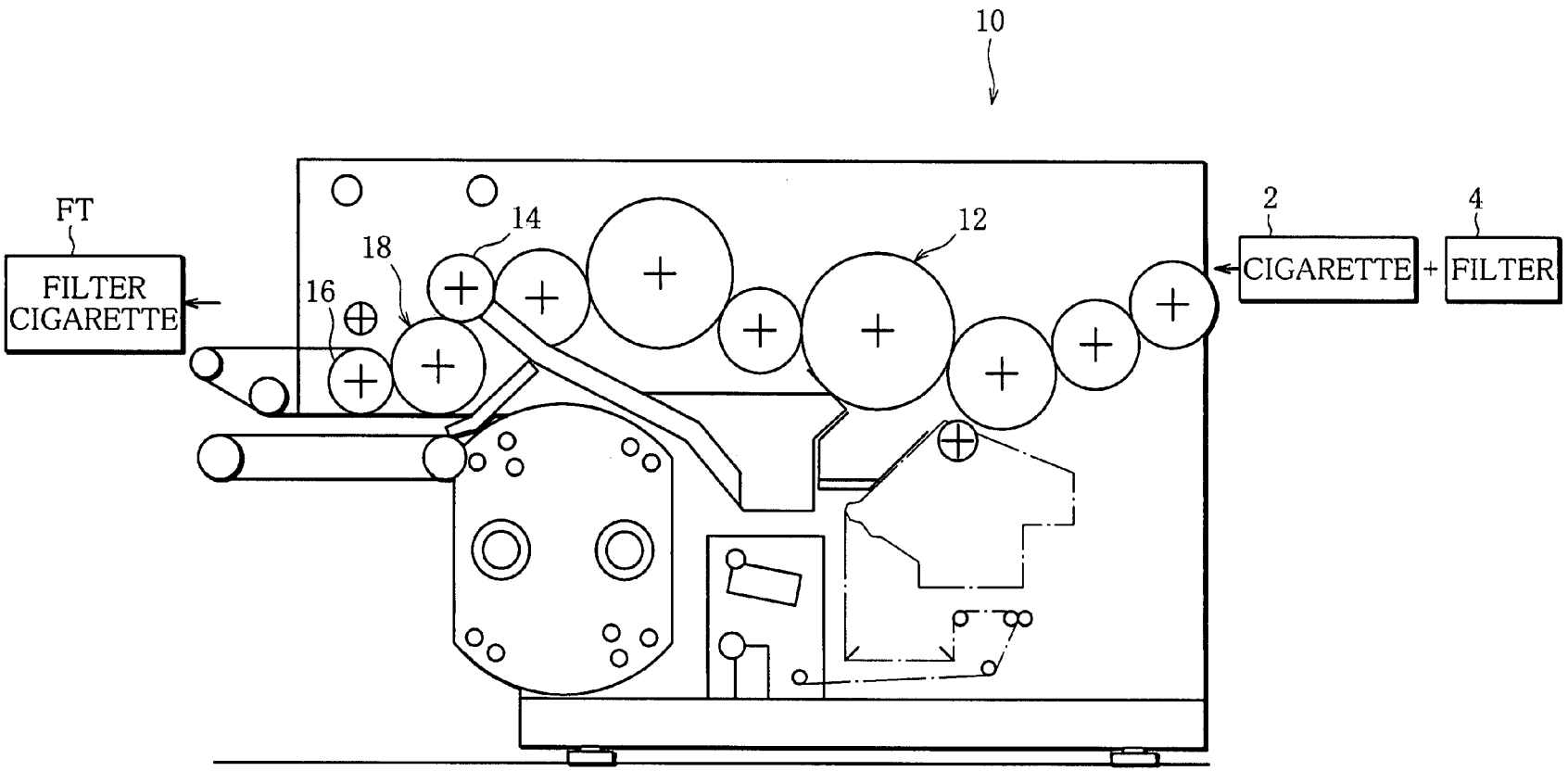
FIG. 1 is a schematic depiction showing a filter attachment of one embodiment.

FIG. 1 diagrammatically shows a filter attachment 10 that attaches a filter to a cigarette. The attachment 10 has a drum line 12 that continues from an upstream side toward a downstream side. The drum line 12 receives a cigarette 2 and a filter 4 on the upstream side (right side in the figure), and attaches the filter 4 to the cigarette 2. The drum line 12 then performs given inspection with respect to an obtained filter cigarette FT, and allows the filter cigarette FT to be removed from the downstream side (left side in the figure). More specifically, the drum line 12 includes a dilution inspection apparatus 18 interposed between an end checker drum 14 and a carrier drum 16.

Figure 2:
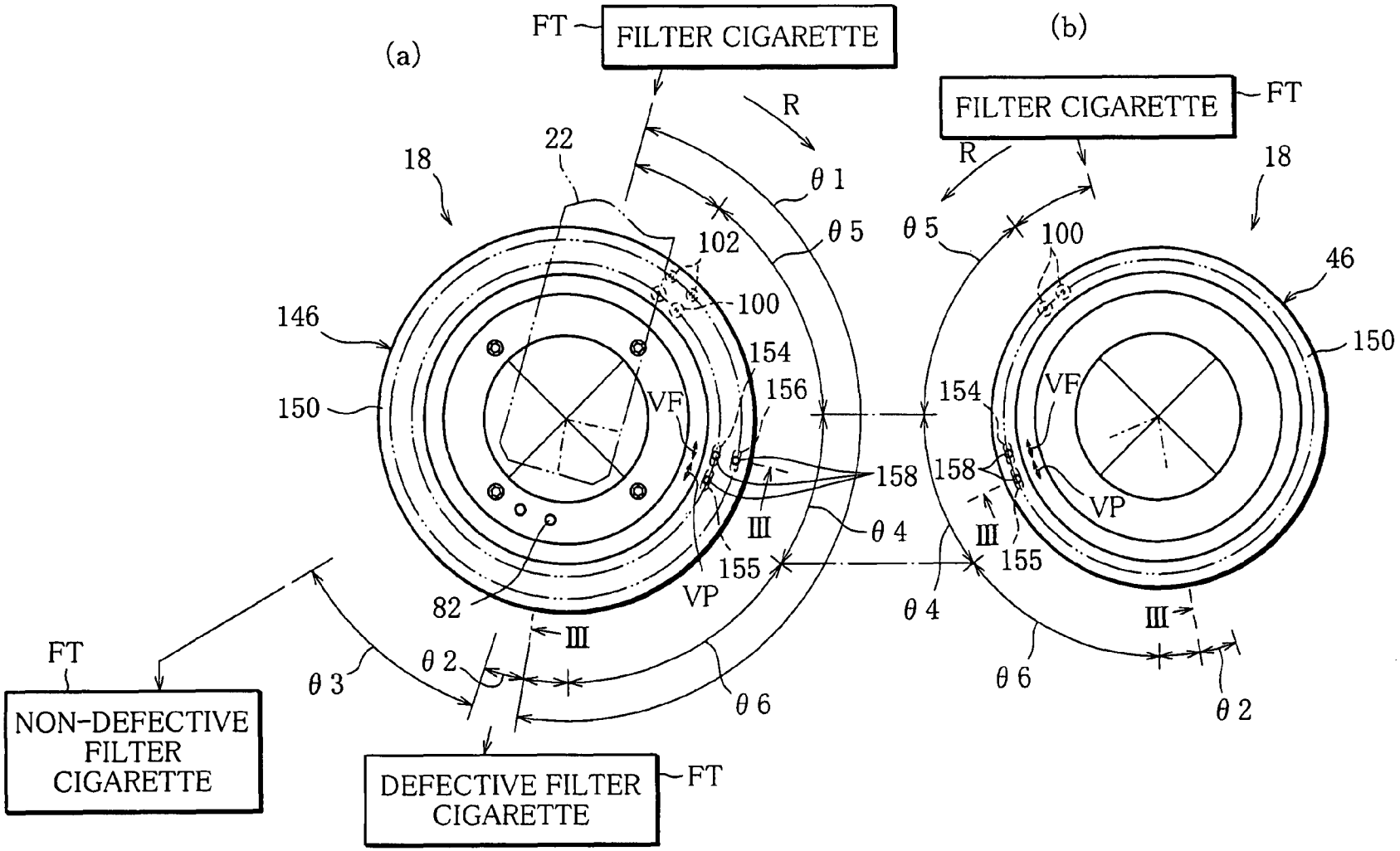
FIG. 2 is a side view of a dilution inspection apparatus installed in the filter attachment of FIG. 1.

FIG. 2 shows both ends of the dilution inspection apparatus 18. The filter cigarette FT to be inspected is transferred to the dilution inspection apparatus 18 at a start point of a rotation angle region θ1 from the end checker drum 14 located immediately upstream thereof. Thereafter, the cigarette FT is transported on an outer circumference of the dilution inspection apparatus 18 along a rotating direction R through the rotation angle region θ1, a rotation angle region θ2 and a rotation angle region θ3, and is transferred to the carrier drum 16 located immediately downstream at an end point of the rotation angle region θ3.

In the dilution inspection apparatus 18, while the filter cigarette is transported through a rotation angle region θ4 located in the rotation angel region θ1, filter ventilation $V_F$ Of the cigarette FT and undesired holes produced in wrapping paper of the cigarette 2 of the cigarette FT are inspected in order. Filter cigarettes FT in which defects are found in a result of the inspection are eliminated from the dilution inspection apparatus 18 in the rotation angle region θ2.

Figure 3:
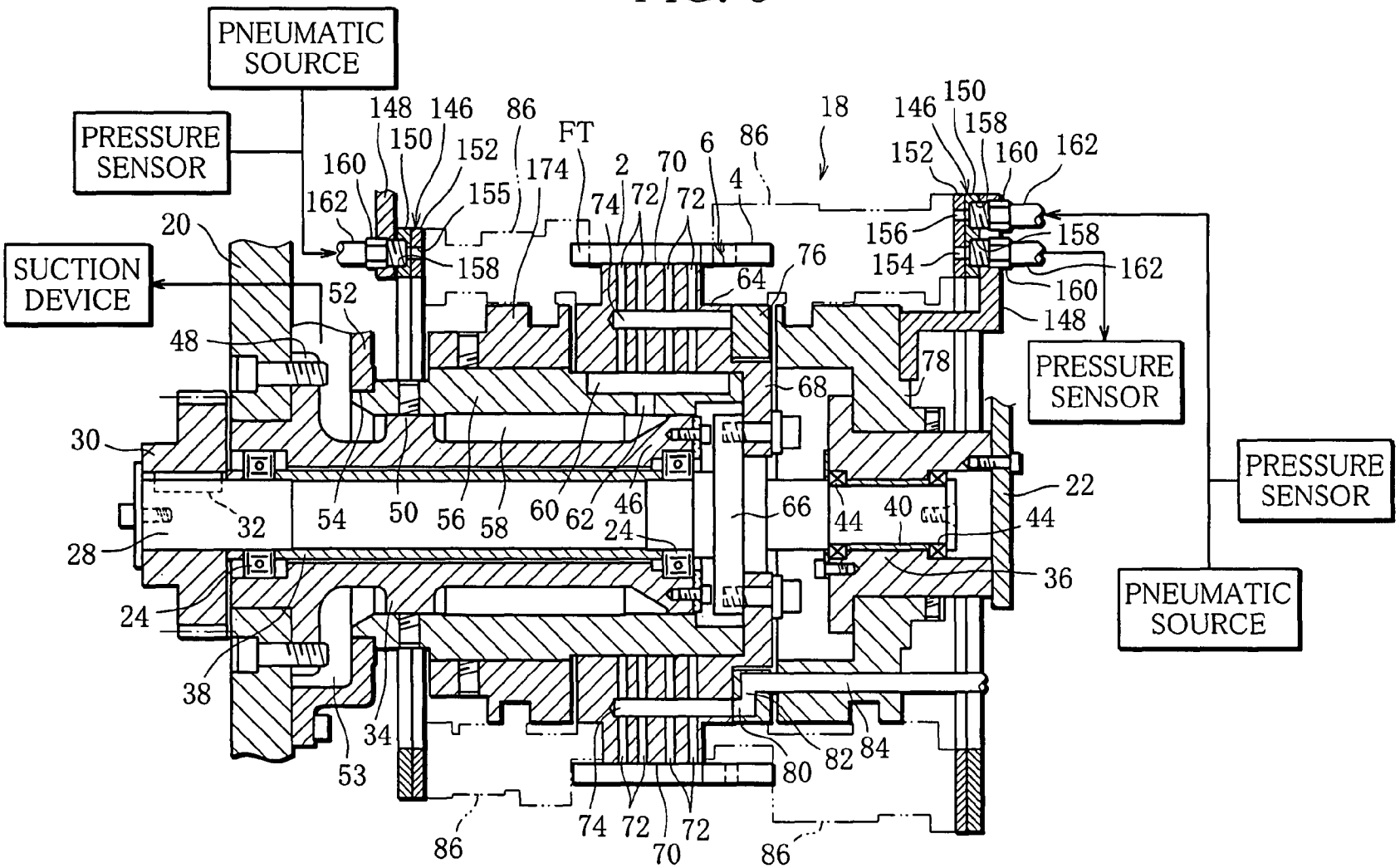
FIG. 3 is a sectional view, taken along line III-III of the dilution inspection apparatus of FIG. 2.

As illustrated in FIG. 3, the filter attachment 10 is provided with a base frame 20 and a sub-frame 22 disposed opposite each other. The inspection apparatus 18 is disposed between the base frame 20 and the sub-frame 22.

To be more specific, the dilution inspection apparatus 18 has a drive shaft 28, which horizontally extends from the base frame 20 toward the sub-frame 22. One end portion and an intermediate portion of the drive shaft 28 are rotatably supported by an inner sleeve 34 through a pair of bearings 24. The inner sleeve 34 horizontally protrudes from a front side of the base frame 20 in a state where one end thereof is fitted into the base frame 20, and at the same time is fixed to the base frame 20 through a flange 48 located on the one end side thereof.

One end of the drive shaft 28 protrudes from the inner sleeve 34 to a backside of the base frame 20, and a drive gear 30 is fitted to the protruding end through a key 32. The drive gear 30 is connected to a drive source through a gear line, not shown. The drive shaft 28 can be rotation-driven in the rotating direction R (see FIG. 2) by receiving a driving force from the drive source. A bush 38 is fitted on the drive shaft 28 so as to be located between the bearings 24.

The other end of the drive shaft 28 also protrudes from the inner sleeve 34. The other end portion is rotatably supported by the sub-frame 22. More specifically, a cylindrical bearing holder 36 is fitted to the sub-frame 22, and the other end portion of the drive shaft 28 is supported by the bearing holder 36 through a pair of bearings 44. A bush 40 is fitted with the other end portion of the drive shaft 28 to be located between the bearings 44.

A control sleeve 56 is fastened onto an outer circumferential surface of the inner sleeve 34 with a screw. One end of the control sleeve 56 is airtightly fitted to a suction duct 52, and the other end thereof protrudes from the inner sleeve 34.

The suction duct 52 is formed with a cover plate. The cover plate is fixed to a front side of the base frame 20 and accommodates the flange 48 of the inner sleeve 34. The suction duct 52 forms a suction path 53 in consort with the base frame 20. The suction path 53 is connected to a suction device, namely a blower.

There is formed a circumferential groove in the outer circumferential surface of the inner sleeve 34. The circumferential groove forms a suction chamber 58 in between the groove and an inner face of the control sleeve 56. The suction chamber 58 constantly communicates with the suction path 53 through one end side thereof. In other words, in the outer circumferential surface of the inner sleeve 34, there are formed a plurality of communication grooves that cause the suction chamber 58 and the suction path 53 to communicate with each other. The communication grooves are arranged at intervals in a circumferential direction of the inner sleeve 34. As a consequence, the suction chamber 58 is constantly supplied with given suction pressure.

A suction groove 60 is formed in an outer circumferential surface of the control sleeve 56. The suction groove 60 communicate with the suction chamber 58 through a plurality of radial holes 62. To be concrete, the suction groove 60 is positioned on the other end side of the control sleeve 56, and has given width in the axial direction of the control sleeve 56. The suction groove 60 extends in a circumferential direction of the control sleeve 56 in the rotation angle region θ1 and the rotation angle region θ3, excluding the rotation angle region θ2. One end of each of the radial holes 62 opens in a bottom face of the suction groove 60. The radial holes 62 are arranged at given intervals in the circumferential direction of the control sleeve 56. The other end of each of the radial holes 62 opens in the inner circumferential surface of the control sleeve 56.

A drum shell 64 is rotatably fixed to the other end side of the control sleeve 56 in a state where the drum shell partially encloses the outer circumferential surface of the control sleeve 56. The drum shell 64 is integrally coupled to the drive shaft 28. More specifically, an outer flange 66 and an inner flange 68 extend from the drive shaft 28 and the drum shell 64, respectively. The flanges 66 and 68 are joined together with connecting screws. Therefore, the drum shell 64 is rotation-driven integrally with the drive shaft 28.

The drum shell 64 airtightly covers the suction groove 60 of the control sleeve 56. A great number of transport grooves 70 are formed in an outer circumferential surface of the drum shell 64 at regular intervals in a circumferential direction thereof. Each of the transport grooves 70 extends in the axial direction of the drum shell 64, and is formed to be shorter than the cigarette 2 of the filter cigarette FT and to have a semicircular cross section. One end of each of suction holes 72 opens at a bottom of each of the transport grooves 70, and these openings are aligned along the transport grooves 70. The suction holes 72 extend in a radial inward direction of the drum shell 64, and the other ends open in an inner circumferential surface of the drum shell 64.

Furthermore, axial holes 74 are formed in the drum shell 64 correspondingly to the respective transport grooves 70. The axial holes 74 each extend across the suction holes 72 of the respective transport grooves 70 and open in an end face of the drum shell 64 on the inner flange 68 side.

There is disposed a control ring 76 outside the inner flange 68 of the drum shell 64, and the end face of the drum shell 64 is in sliding contact with the control ring 76. Accordingly, the opening ends of the axial holes 74 are covered with the control ring 76. The control ring 76 is supported by a fixed cylinder 78 using a pin and a coil spring (both not shown) such that the control ring 76 cannot rotate. The fixed cylinder 78 is fitted to an outer circumferential surface of the bearing holder 36. The coil spring urges the control ring 76 to press against the end face of the drum shell 64. The end face of the drum shell 64 and the control ring 76 are in airtight contact with each other.

Formed in an inner end face of the control ring 76 is a control groove 80 for elimination. The control groove 80 stretches over the rotation angle region θ2 (see FIG. 2) so as to have an arc-like shape. A communication hole 82 extends from a bottom of the control groove 80, and opens in an outer end face of the control ring 76. Connected to an opening end of the communication hole 82 is one end of an elimination tube 84. The elimination tube 84 stretches through the fixed cylinder 78. Therefore, along with rotation of the drum shell 64, the axial holes 74 are sequentially connected to the elimination tube 84 through the control groove 80. Although not shown, the elimination tube 84 is connected to a pneumatic source including a compressor and the like through an electromagnetic valve, so that it is possible to supply given elimination pressure through the control groove 80 to the axial holes 74 by switching operation of the electromagnetic valve.

Although not shown, in the inner end face of the control ring 76, there is formed an atmosphere open groove immediately downstream of the rotation angle region θ3 in the rotating direction R of the drum shell 64. The atmosphere open groove constantly opens to atmosphere.

When the transport groove 70 enters the rotation angle region θ1, that is, the suction groove 60, along with the rotation of the drum shell 64, the suction pressure is supplied from the suction chamber 58 through the radial holes 62 and the suction holes 72 to the transport groove 70. As a result, the transport groove 70 is capable of sucking and receiving the filter cigarette FT from the end checker drum 14 of the previous step. Thereafter, the filter cigarette FT is transported while being sucked and held by the transport groove 70 during the period of passing through the rotation angle region θ1 and the rotation angle region θ3. During the period in which the filter cigarette FT passes through the rotation angle θ2, the supply of the suction pressure to the transport groove 70 is stopped. Unless the elimination pressure is supplied, however, the filter cigarette FT continues to be sucked and held by the transport groove 70 due to remaining pressure, and is transported passing through the rotation angle region θ2.

When the transport groove 70 further rotates beyond the rotation angle region θ3 and is connected to the axial holes 74 of the transport groove 70 to the atmosphere open groove of the control ring 76, the suction of the filter cigarette FT is cancelled at this point. The released filter cigarette FT is transferred to the carrier drum 16 of the subsequent step, which is located immediately downstream of the inspection apparatus 18, that is, the drum shell 64, and continues to be transported.

The drum shell 64 is attached with a plurality of pairs of assemblies 86. Each of the transport grooves 70 is interposed between one pair of assemblies 86 in the axial direction thereof. The assemblies 86 rotate with the drum shell 64, that is to say, the respective transport grooves 70.

One pair of assemblies 86 can move toward the filter cigarette FT placed on the transport groove 70 and away therefrom along with the rotation of the drum shell 64. To be concrete, the pair of assemblies 86 is reciprocating-driven between an actuated position where they advance to the filter cigarette FT side and a rest position where they retreat from the actuated position.

More specifically, when the pair of assemblies 86 is located at the start end of the rotation angle region θ1 shown in FIG. 2, these assemblies 86 are placed in the rest position.

As to the reciprocating drive of the assemblies 86, the rotation angle region θ1 is further divided into a rotation angle region θ4 located at the center in the rotating direction R, and rotation angle regions θ5 and θ6 located upstream and downstream of the rotation angle region θ4, respectively, to be adjacent to each other. In other words, the pair of assemblies 86 is gradually advanced from the rest position toward the actuated position while passing through the rotation angle region θ5, and is held at the actuated position while passing through the rotation angle region θ4. Subsequently, the pair of assemblies 86 is gradually retreated from the actuated position toward the rest position while passing through the rotation angle region θ6, and is held at the rest position until reaching a start end of the rotation angle region θ5 again.

In FIG. 3, the assemblies 86 are shown simply by chain double-dashed lines. Facing into FIG. 3, an upper side pair of assemblies 86 is located in the actuated position, and a lower side pair of assemblies 86 in the rest position.

Hereinafter, between the assemblies 86 in pair, the assembly 86 positioned on the right side of the transport groove 70 and located in the rest position in FIG. 3 will be described with reference to FIG. 4. Although in FIG. 4, the pair of assemblies 86 located in the rest position is placed on an upper side of the drum shell 64 differently from the case shown in FIG. 3, this is for the convenience of drawing the figure.

Figure 4:
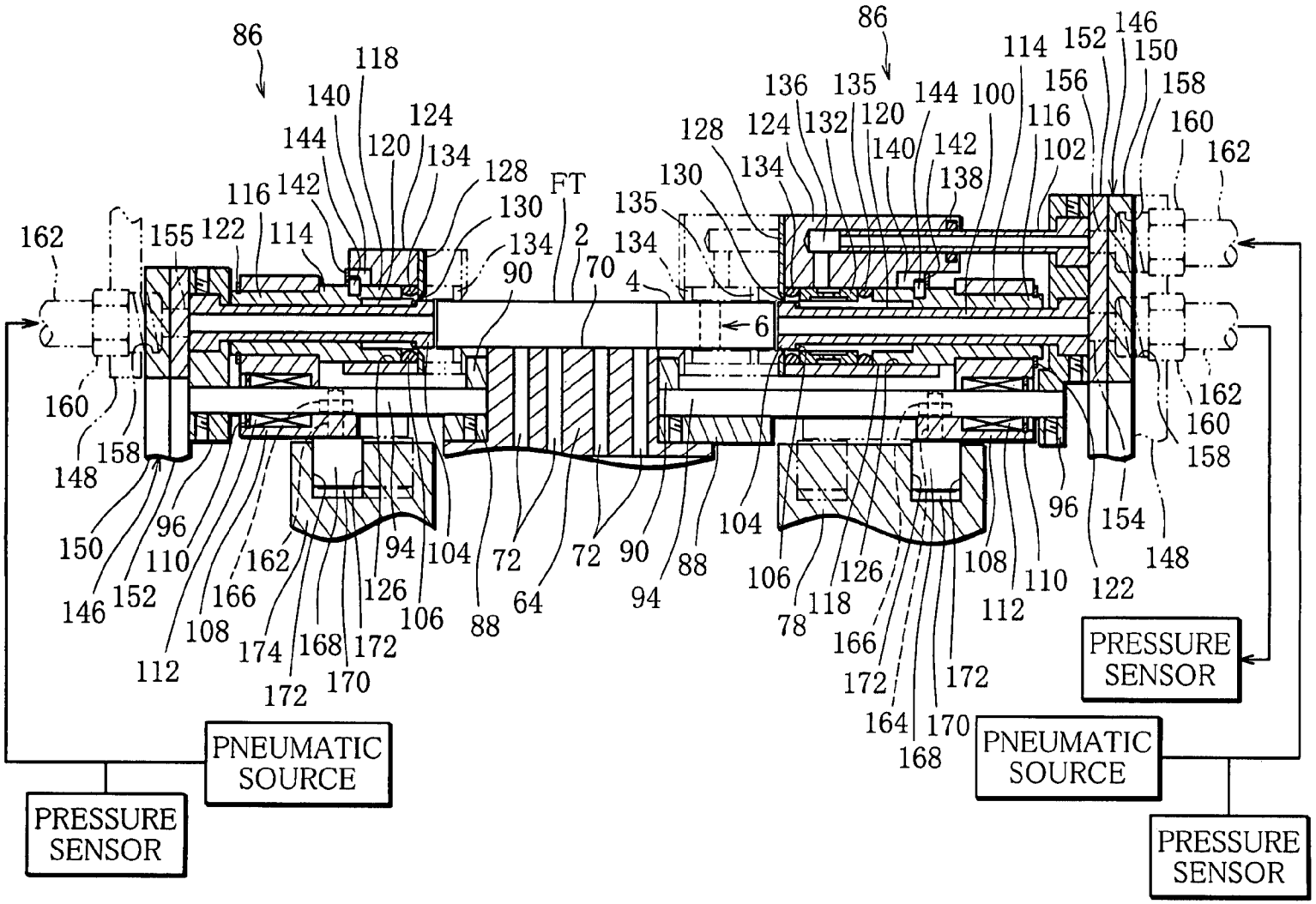
FIG. 4 is a sectional view of an assembly included in the dilution inspection apparatus of FIG. 3.

As is apparent from FIG. 4, the drum shell 64 has small-diameter portions on both ends of the transport groove 70. A support ring 88 is concentrically fitted on the right small-diameter portion. The support ring 88 is formed to have a large-diameter step on the transport groove 70 side, and has an end wall 90 in contact with the end face of the drum shell 64.

Fixed to the end wall 90 is one end of a guide rod 94. The guide rod 94 extends in the axial direction of the drum shell 64. The other end of the guide rod 94 is fixed to a rotation ring 96. The rotation ring 96 is disposed concentrically with the support ring 88 on the other end side of the drum shell 64.

Two guide pipes 100 and 102 are fixed to the rotation ring 96. The guide pipes 100 and 102 protrude from the front side of the rotation ring 96 toward the support ring 88 and stretch parallel to the guide rod 94. The guide pipes 100 and 102 are arranged in a radial outward direction of the support ring 88 with a space therebetween in the order named from the guide rod 94. In other words, the guide rod 94 and the guide pipe 102 are positioned on their respective sides of the guide pipe 100 in the radial direction. Base ends of the guide pipes 100 and 102 are embedded in the rotation ring, and open in a backside of the rotation ring 96.

The guide pipe 100 is positioned coaxially with the transport groove 70, that is to say, the filter cigarette FT held by the transport groove 70, and has a large diameter end 104 at a tip end thereof.

A movable sleeve 114 is slidably fitted on the guide pipe 100 from the outside. A slider 108 is attached to an end portion of the movable sleeve 114, which is located on the rotation ring 96 side. The guide rod 94 pierces the slider 108 with a slide bearing 112 interposed therebetween. The slider 108 is slidably supported by the guide rod 94. The slide bearing 112 is held in the slider 108 with a snap ring 110 interposed therebetween. A snap ring 122 of the movable sleeve 114 couples the movable sleeve 114 with the slider 108 integrally. Accordingly, the slider 108 is slidably guided by the guide rod 94, thereby being able to move toward and away from the drum shell 64 in the axial direction thereof together with the movable sleeve 114. The movable sleeve 114 coaxially contacts/separates with respect to the transport groove 70, or the filter cigarette FT to be inspected, which is held by the transport groove 70.

An internal diameter of the movable sleeve 114 is enlarged in an end portion 118 on the support ring 88 side. There is secured a tubular chamber 120 between the movable sleeve 114 and the guide pipe 100. The tubular chamber 120 opens toward the large diameter end 104 side of the guide pipe 100. An external diameter of the tubular chamber 120 is larger than an external diameter of the large diameter end 104.

When the assembly 86 is placed in the actuated position, the movable sleeve 114 moves closest to the cigarette FT, and the large diameter end 104 of the guide pipe 100 enters the tubular chamber 120 of the movable sleeve 114. At this moment, an O-ring 106 provided to the large diameter end 104 is in tight contact with an inner end face of the tubular chamber 120, and the tubular chamber 120 is airtightly sealed by the O-ring 106.

The end portion 118 of the movable sleeve 114 is slidably inserted in a ring-attaching hole 126 of a ring holder 124. The ring-attaching hole 126 pierces the ring holder 124 and opens in both end faces thereof. A portion of the guide pipe 100 located on the large diameter end 104 side is concentrically disposed in the ring-attaching hole 126.

An end plate 128 is fixed to one end face of the ring holder 124, which is located on the drum shell 64 side. Formed in the end plate 128 is a slot 130 located concentrically with the ring-attaching hole 126. The slot 130 has a smaller diameter than the ring-attaching hole 126. The ring-attaching hole 126 and the slot 130 have respective internal diameters larger than the external diameter of the filter cigarette FT. For this reason, when the assembly 86 moves from the rest position to the actuated position, the filter-side end portion of the filter cigarette FT is insertable into the ring-attaching hole 126 through the slot 130.

In the ring holder 124, a guide hole 136 is formed parallel with the ring-attaching hole 126. The guide hole 136 has a closed end on one end face side of the ring holder 124, and opens in the other end face of the ring holder 124, that is, an end face on the rotation ring 96 side. A guide pipe 102 is airtightly and slidably inserted into the guide hole 136 from the opening thereof through an O-ring 138.

A radial hole extends from the closed end of the guide hole 136 toward the ring-attaching hole 126. The radial hole opens in an inner circumferential surface of the ring-attaching hole 126, and this opening end is located in an intermediate position between the movable sleeve 114 and the end plate 128.

Furthermore, an axial groove 140 is formed in the inner circumferential surface of the ring-attaching hole 126. The axial groove 140 opens in the other end face of the ring holder 124. The axial groove 140 is attached with a stopper 142, and a pin 144 projects from an outer circumferential surface of the movable sleeve 114 into the axial groove 140. When the assembly 86 is in the rest position, the pin 144 is in contact with the stopper 142 in the axial groove 140. Additionally, the pin 144 works so as to push back the ring holder 124 through the stopper 142 when the assembly 86 moves from the actuated position to the rest position as described below.

Disposed in the ring-attaching hole 126 is an inner cylinder 132. The inner cylinder 132 is positioned in between the movable sleeve 114 and the end plate 128. The inner cylinder 132 is brought into slide contact with the inner circumferential surface of the ring-attaching hole 126 and is movable in the axial direction of the ring-attaching hole 126. The inner cylinder 132 has an internal diameter that is larger than the external diameter of the filter cigarette FT, so that the end portion of the filter cigarette FT can be inserted into the inner cylinder 132 when the assembly 86 is moved to the actuated position.

In the inner cylinder 132, circumferential grooves are formed in inner and outer circumferential surfaces thereof, and there are also arranged in a circumferential direction thereof a plurality of small holes for causing the circumferential grooves to communicate with each other. The outer circumferential groove communicates with the guide hole 136 through the radial hole. Therefore, the guide pipe 102 communicates with the ring-attaching hole 126 through the outer and inner circumferential grooves and the small holes of the inner cylinder 132.

Rubber rings 134 and 135 made of silicone rubber are accommodated in the ring-attaching hole 126 so as to be located on both ends of the inner cylinder 132. The rubber ring 134 is held between the inner cylinder 132 and the end plate 128, and the rubber ring 135 between the inner cylinder 132 and the movable sleeve 114. Accordingly, the rubber rings 134 and 135 are separated away from each other in the axial direction of the ring-attaching hole 126. Both the rubber rings 134 and 135 are elastically deformable, and they are in a free state when the assembly 86 is in the rest position. In the free state, internal diameters of the rubber rings 134 and 135 are larger than the external diameter of the filter cigarette FT, making it possible to insert the cigarette FT into the rubber rings 134 and 135 without contact.

As shown by a chain double-dashed line in FIG. 4, when the ring holder 124 is placed in the actuated position, the rubber rings 134 and 135 are compressed between the end plate 128 and the inner cylinder 132, and between the inner cylinder 132 and the movable sleeve 114, respectively, in the axial direction of the ring-attaching hole 126 as described below. In this case, since outer circumferences of the rubber rings 134 and 135 are restrained by the ring-attaching hole 126, internal circumferences of the compressed rubber rings 134 and 135 stretch in a radial inward direction to reduce the diameters of the rings. At this moment, if the filter of the filter cigarette FT has passed through the rubber rings 134 and 135 and has been inserted in the ring-attaching hole 126, inner circumferential surfaces of the rubber rings 134 and 135 that are reduced in diameters come into tight contact to the outer circumferential surface of the filter of the filter cigarette FT with no space. At this point, a perforation line 6 of the filter cigarette FT is positioned between the rubber rings 134 and 135.

In such a state, the inside of the ring-attaching hole 126 is airtightly sectioned into a surrounding chamber that encircles the outer circumferential surface of the filter in between the rubber rings 134 and 135 in the compressed state, and an end chamber located between the rubber ring 135 and the bottom of the tubular chamber 120. The perforation line 6 of the filter cigarette FT is positioned in the surrounding chamber, and an end portion of the filter 4 is located in the end chamber (FIG. 6 clearly shows the surrounding and end chambers). As is apparent from the foregoing, the surrounding chamber communicates with the guide pipe 102, and the end chamber with the guide pipe 100.

The inner circumferential surfaces of the elastically deformable rubber rings 134 and 135 stretch to be fitted to concaves and convexes of the outer circumferential surface of the filter. Therefore, a satisfactorily sealed state is created between the rubber rings 134 and 135 and the filter. Moreover, it is unlikely that the outer circumferential surface of the filter 4 is overly constricted by the rubber rings 134 and 135 to crinkle the outer circumferential surface of the filter 4, or tip paper.

A stationary ring 146 is in tight contact to a back face of the rotation ring 96. The stationary ring 146 is disposed coaxially with the rotation ring 96. As illustrated in FIG. 3, the stationary ring 146 is supported by a ring-shaped support plate 148. The support plate 148 has an inner circumferential portion that is bent and attached to the fixed cylinder 78 to be fastened to the fixed cylinder 78 with a bolt. Although not shown, a spring is interposed between the support plate 148 and the stationary ring 146. The spring presses the stationary ring 146 toward the rotation ring 96.

The stationary ring 146 is formed of an outer ring 150 and an inner ring 152 that are superposed upon each other. Opening ends of the guide pipes 100 and 102, which open in the back face of the rotation ring 96, are airtightly closed by the inner ring 152.

Formed in the inner ring 152 are slots 154, 155 and 156 serving as after-mentioned input/output portions of measurement pressure and detection pressure. Among these slots, the slots 154 and 156 extend in a prescribed rotation angle region VF in a circumferential direction of the inner ring 152 in a state where they are detached away from each other in a radial direction of the inner ring 152. Referring to FIG. 2, the rotation angle region VF is defined within the rotation angle region θ4.

The slot 154 is positioned to be able to fit to the opening end of the guide pipe 100 and has width that is slightly larger than the internal diameter of the guide pipe 100. The slot 156 is positioned to be able to fit to the opening end of the guide pipe 102 and has width that is slightly larger than the internal diameter of the guide pipe 102.

Although as illustrated in FIG. 2, the last slot 155 is formed on the circumference where the slot 154 is positioned, the slots 154 and 155 are separated away from each other in the circumferential direction of the inner ring 152. The slot 155 extends over a rotation angle region VP, which is defined within the rotation angle region θ4 to be located downstream from the slot 154.

A plurality of connection holes 158 are formed in the outer ring 150 correspondingly to the slots 154, 155 and 156. The connection holes 158 pierce through the outer ring 150 to communicate with the respective slots 154, 155 and 156. Air tubes 162 are connected to the respective connection holes 158 through respective nipples 160.

The air tube 162 that communicates with the slot 156 is connected to a pressure sensor and a pneumatic source. Therefore, when the guide pipe 102 is connected to the slot 156, the pneumatic source can supply the measurement pressure to the surrounding chamber through the air tube 162, the guide pipe 102, etc., and the pressure sensor monitors the measurement pressure.

Pressure sensors are connected to the respective air tubes 162 connected to the slots 154 and 155. The pressure sensors measure pressure of the end chamber.

As illustrated in FIG. 4, a roller shaft 164 projects from the slider 108 toward the fixed cylinder 78. The roller shaft 164 is fastened to the slider 108 with a nut 166. A roller 168 serving as a cam follower is rotatably supported by the roller shaft 164. The roller 168 is accommodated in a cam groove 170 of the fixed cylinder 78. The cam groove 170 is formed in an outer circumferential surface of the fixed cylinder 78 over the entire circumference thereof. Both sidewalls 172 and 172 of the cam groove 170 guide a rolling motion of the roller 168.

In other words, when the assembly 86 rotates outside the fixed cylinder 78 along with the rotation of the drum shell 64, the roller 168 moves in the axial direction of the fixed cylinder 78, or the guide rod 94, along a cam profile of the cam groove 170. As a result, the slider 108 makes a reciprocating motion while being guided by the guide rod 94.

Once the slider 108 is moved toward the drum shell 64, the movable sleeve 114 also moves on the guide pipe 100 toward the drum shell 64. The movable sleeve 114 then presses the end plate 128 of the ring holder 124 through the rubber ring 135, the inner cylinder 132 and the rubber ring 134. Consequently, the assembly 86, or the ring holder 124, advances to the actuated position in which the end plate 128 comes into contact with the end wall 90 of the support ring 88.

Thereafter, in the state where the ring holder 124 is in the actuated position, once the slider 108 is moved toward the rotation ring 96 together with the movable sleeve 114, the pin 144 of the movable sleeve 114 pushes back the ring holder 124 through the stopper 142. The ring holder 124 is thereby returned to the rest position.

Even if the ring holder 124 makes the reciprocating motion, the ring holder 124 does not come off from the guide pipe 102. Connection between the guide pipe 102 and the guide hole 136 of the ring holder 124 is constantly retained.

Figure 5:
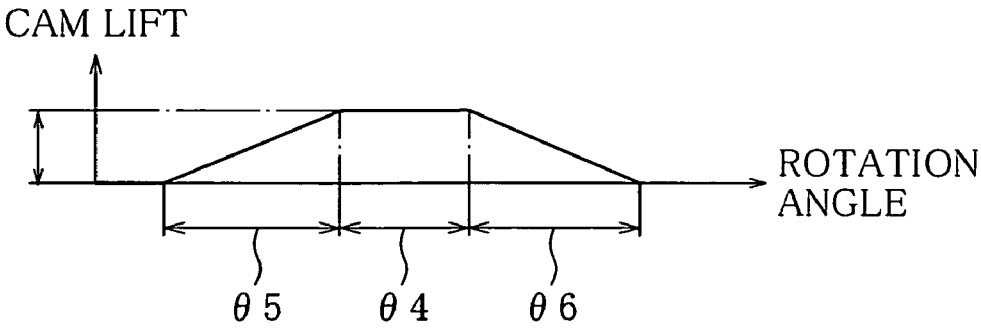
FIG. 5 is a part of a cam diagram showing in the dilution inspection apparatus of FIG. 2.

FIG. 5 shows a cam diagram of the cam groove 170. A horizontal axis indicates a rotation angle of the assembly 86, and a vertical axis represents a cam lift (namely a reciprocating stroke of the movable sleeve 114). As is clear from FIG. 5, the cam lift is gradually increased from the point when the assembly 86 passes through the start end of the rotation angle region θ5. The ring holder 124 accordingly moves toward the actuated position and reaches the actuated position within the rotation angle region θ5.

In the process where the assembly 86 further rotates and enters the rotation angle region θ4, the movable sleeve 114 further moves forward. At this point, however, the ring holder 124 is in the actuated position, and the forward movement of the ring holder 124 is restricted by the end wall 90 of the support ring 88. Therefore, the forward movement of the movable sleeve 114 compresses the rubber ring 135 in between the movable sleeve 114 and the inner cylinder 132, and also compresses the rubber ring 134 in between the end plate 128 and the inner cylinder 132. As a consequence, the internal diameters of the rubber rings 134 and 135 are reduced at this point.

At the same time, the large diameter end 104 of the guide pipe 100 enters the tubular chamber 120 of the movable sleeve 114 together with the O-ring 106, and the pin 144 of the movable sleeve 114 and the stopper 142 of the ring holder 124 are in the state where they are separated away from each other.

When the assembly 86 is in the process of passing through the rotation angle region θ4, the cam lift is maintained at a maximum value, and the rubber rings 134 and 135 are kept in the state where they are reduced in their diameters.

Subsequently, the assembly 86 moves from the rotation angle region θ4 to enter the rotation angle region θ6. In the process where the assembly 86 passes through the rotation angle region θ6, the cam lift is gradually reduced. Accordingly, the compression of the rubber rings 134 and 135 by using the movable sleeve 114 is cancelled, which enlarges the internal diameters of the rubber rings 134 and 135 to the original state. Once the pin 144 of the movable sleeve 114 comes into contact with the stopper 142 of the ring holder 124, the ring holder 124 moves from the actuated position toward the rest position together with the movable sleeve 114.

After the assembly 86 passes through the rotation angle region θ6, the ring holder 124 is maintained in the rest position until the assembly 86 enters the start end of the rotation angle region θ5 again.

The assembly 86 positioned on the left side of the drum shell 64, facing into FIG. 4 as viewed, has a similar structure to the assembly 86 on the right side. Therefore, in FIGS. 2, 3 and 4, members and portions having the same functions are provided with the same reference characters, and explanations thereof will be omitted. Only differences will be described below.

First of all, the cam groove 170 in combination with the left assembly 86 is, as is clear from FIG. 3, formed in an outer circumferential surface of a fixed cylinder 174. The fixed cylinder 174 is fixed onto the outer circumferential surface of the control sleeve 56. The support plate 148 supporting the stationary ring 146 is fixed to a base frame 20.

As illustrated in FIG. 4, the left assembly 86 is not provided with the guide hole 136, the guide pipe 102, the slot 156 and the inner cylinder 132.

The left assembly 86, or the ring holder 124, is provided with the rubber ring 134 only. The rubber ring 134 is disposed between the movable sleeve 114 and the end plate 128. When the assembly 86 is placed in the actuated position, the rubber ring 134 comes into airtight contact to the end portion of the cigarette 2 of the filter cigarette FT from the outside. In this case, the reciprocating stroke of the ring holder 124, provided by the cam groove 170, is set to be virtually half, compared to the ring holder 124 of the right assembly 86.

Accordingly, when the left assembly 86 is in the actuated position, there is formed an end chamber only. The end portion of the cigarette 2 of the filter cigarette FT to be inspected is placed in the end chamber.

The slot 154 of the inner ring 152 opens to the atmosphere through the holes formed in the outer ring 150. Therefore, even if the left assembly 86 is placed in the actuated position, and the end chamber is formed, pressure of the end chamber is maintained to be atmosphere pressure through the slot 154 of the rotation angle region VF.

Furthermore, the pneumatic source is connected to the air tube 162 connected to the slot 155 of the left assembly 86 with the pressure sensor. Consequently, as assembly 86 is passing through the rotation angle region VP in which the slot 155 is formed, the pneumatic source can supply the measurement pressure to the end chamber, and the measurement pressure is monitored by the pressure sensor.

Figure 6:
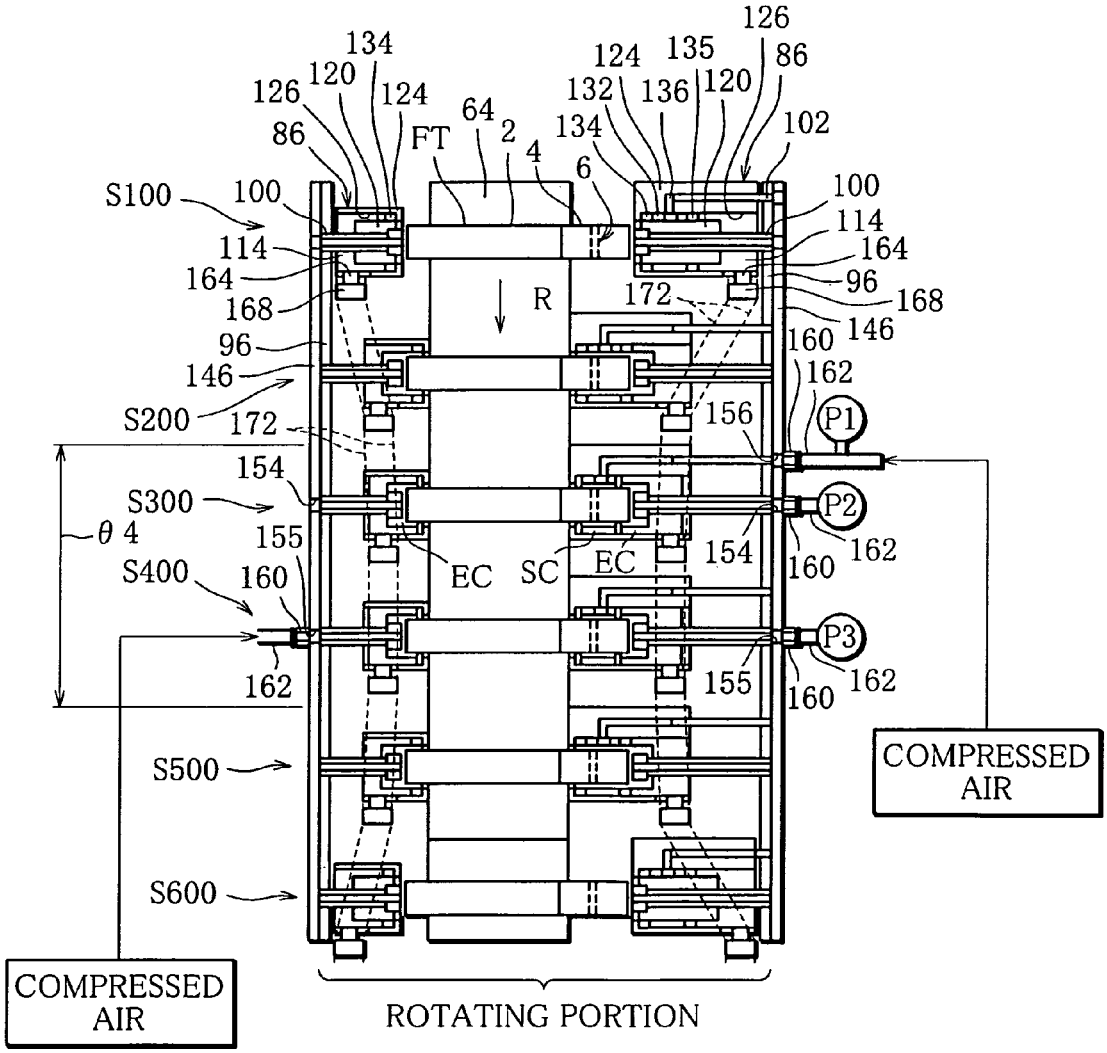
FIG. 6 is an explanatory view of operation of the assembly along with rotation of a drum shell in the dilution inspection apparatus of FIG. 2.

FIG. 6 diagrammatically shows the operation of one pair of assemblies 86 in the dilution inspection apparatus 18.

According to the inspection apparatus 18, at the start end of the rotation angle region θ1 of the drum shell 64, the filter cigarette FT is transferred from the end checker drum 14 of the previous step into one of the transport grooves 70 (S100). At this moment, the pair of assemblies 86 in combination with the above-mentioned transport groove 70 is in the rest position. The filter cigarette FT is securely received by the transport groove 70 without interfering with the assemblies 86. The tip end of the cigarette 2 of the filter cigarette FT and the filter 4 project from both the ends of the transport groove 70.

Subsequently, along with the rotation of the drum shell 64, the filter cigarette FT is transported while being sucked and held by the transport groove 70. Once the filter cigarette FT enters the rotation angle region θ5, the pair of assemblies 86 gradually moves forward from the rest position toward the actuated position, that is, toward the filter cigarette FT on the transport groove 70.

Once the pair of assemblies 86 is placed in the actuated position (S200), both the end portions of the filter cigarette FT are inserted into the ring-attaching holes 126 formed in the right and left ring holders 124 through the slots 130 of the end plates 128.

Thereafter, the rubber rings 134 and 135 in the right and left ring holders 124 each receive a compressive force to be reduced in their diameters, thereby coming into airtight contact onto the outer circumferential surface of the filter cigarette FT. There are formed an end chamber EC and a surrounding chamber SC in the right ring holder 124, whereas in the left ring holder 124, there is formed an end chamber EC only (S300).

The filter cigarette FT passes through the rotation angle region VF with the pair of assemblies 86 in the state where the end chambers EC and the surrounding chamber SC are formed. During the period in which the cigarette FT passes through the rotation angle region VF, the guide pipe 102 of the assembly 86 located on the filter 4 side (the right side, facing into FIG. 6 as viewed) is connected to the air tube 162. As a result, compressed air is fed into the surrounding chamber SC at a pressure monitored by a pressure sensor P1, which generates measurement pressure (input pressure) in the surrounding chamber SC. The measurement pressure is applied to the outer circumferential surface of the filter 4 of the filter cigarette FT. Based on the measurement pressure, the compressed air is directed through the perforation line 6 into the filter 4, and then flows into the end chamber EC from the end face of the filter 4. Consequently, the pressure that is reduced to be less than the measurement pressure is produced as detection pressure (output pressure) in the end chamber EC.

At this point, the guide pipe 100 is connected to a pressure sensor P2 through the air tube 162, so that the detection pressure in the end chamber EC is detected by the pressure sensor P2. Since the rubber rings 134 and 135 of the right ring holder 124 are in airtight contact to the filter 4 of the filter cigarette FT, the compressed air does not leak out of the surrounding chamber SC and the end chambers EC. Therefore, the pressure sensors P1 and P2 are capable of detecting with accuracy the measurement pressure and the detection pressure, respectively.

In the rotation angle region VF, the pressure in the end chamber EC of the left ring holder 124 is maintained to the same level as the atmosphere pressure.

After passing through the rotation angle region VF, the filter cigarette FT enters the rotation angle region VP with the pair of assemblies 86. During the period in which the cigarette FT passes through the rotation angle region VP, the guide pipes 100 of the right and left assemblies 86 are connected to the respective air tubes 162 (S400). By so doing, the compressed air is fed into the end chamber EC of the left assembly 86, and the measurement pressure in the end chamber EC is applied to the cigarette end of the filter cigarette FT. In the right assembly 86, the guide pipe 102 leading to the surrounding chamber SC is airtightly sealed by the stationary ring 146. The guide pipe 100 leading to the end chamber EC is connected to a pressure sensor P3 through the air tube 162. The pressure sensor P3 detects the detection pressure (output pressure) in the end chamber EC of the right assembly 86, which corresponds to the measurement pressure (input pressure) in the end chamber EC of the left assembly 86. In other words, when the measurement pressure is applied to the cigarette end, the measurement pressure is transmitted to the filter end of the filter cigarette FT while being reduced. The transmitted pressure appears as the detection pressure.

Again, the rubber rings 134 and 135 of the ring holders 124 are in airtight contact onto the outer circumferential surface of the filter cigarette FT, so that air does not leak out of the surrounding chamber SC and the end chamber EC. This enables the pressure sensor P3 to detect the detection pressure with accuracy.

Subsequently, when the filter cigarette FT passes through the rotation angle region VP and enters a rotation angle region θ6, the internal diameters of the rubber rings 134 and 135 are enlarged into the original state to be detached away from the outer circumferential surface of the filter cigarette FT in the right and left assemblies 86 (S500). The assemblies 86 are moved from the actuated position toward the rest position, and both the end portions of the filter cigarette FT are relatively pulled out of the assemblies 86.

After the right and left assemblies 86, that is, the ring holders 124, are detached away from the filter cigarette FT as described above (S600), if the filter cigarette FT is judged to be defective, it is removed in the rotation angle region θ2. As a consequence, only non-defective cigarettes FT are transported to a dead end of the rotation angle region θ3 and transferred from the transport grooves 70 to the carrier drum 16 of the subsequent step to be further transported.

Figure 7:
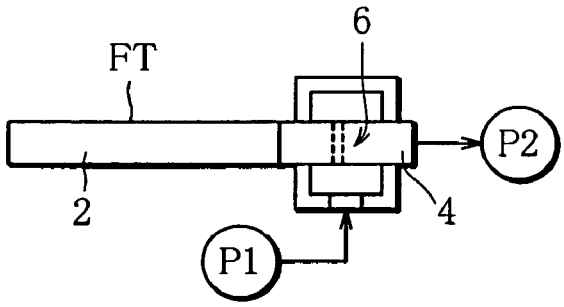
FIG. 7 is a schematic depiction of filter ventilation measurement in the dilution inspection apparatus of FIG. 2.
Figure 8:
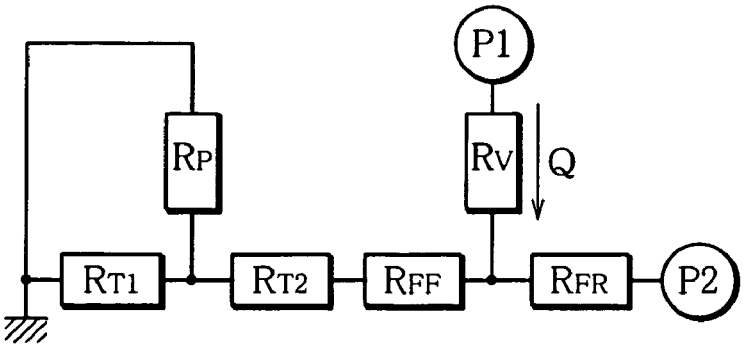
FIG. 8 is a diagram showing an analogy model of the filter ventilation measurement of FIG. 7.

FIG. 7 diagrammatically shows a measurement principle performed in the rotation angle region VF in the inspection apparatus 18. According to this measurement principle, it is possible to find the filter ventilation VF in the filter cigarette FT. The VF is as mentioned the ratio of an air amount flowing in from the perforation line to an amount of smoke drawn by the smoker. FIG. 8 shows an analogy model in which the measurement principle is replaced with an electric equivalent circuit. According to the analogy model, when the measurement pressure and the detection pressure measured by the pressure sensors P1 and P2 are denoted by P1 and P2, respectively, the ratio of the detection pressure P2 to the measurement pressure P1, that is, P2/P1, is shown by the following equation.

[Equation 1]

$$\frac{P2}{P1} = \frac{R_P(R_{T1} + R_{T2} + R_{FF}) + R_{T1}(R_{T2} + R_{FF})}{R_P(R_{T1} + R_{T2} + R_{FF} + R_V) + R_{T1}(R_{T2} + R_{FF} + R_V)} \quad (1)$$

The right side of Equation (1) is identical to a resistance equation (Equation (3)) of the $V_F$ in an after-mentioned measurement standard. In other words, the $V_F$ is a value found by dividing the detection pressure P2 by the measurement pressure P1. It is possible to directly find and monitor the $V_F$ by substituting the measurement pressure P1 and the detection pressure P2 in Equation (1).

Characters in Equation (1) represent the following matters.

$R_{T1}$: Equivalent resistance of the cigarette end side, which is created when air flows within the cigarette 2 of the filter cigarette FT.

$R_{T2}$: Equivalent resistance of the filter side, which is created when air flows within the cigarette 2 of the filter cigarette FT.

$R_{FF}$: Equivalent resistance of the cigarette 2 side, which is created when air flows within the filter 4 of the filter cigarette FT.

$R_{FR}$: Equivalent resistance of the filter end side, which is created when air flows within the filter 4 of the filter cigarette FT.

$R_P$: Equivalent resistance created when air flows from the outside of the cigarette 2 into the cigarette 2 through wrapping paper.

$R_V$: Equivalent resistance created when air flows from the outside of the filter 4 into the filter 4 through tip paper including the perforation line 6.

Therefore, the inspection apparatus 18 enables effective control of the nicotine and tar of the filter cigarette FT. For example, if a calculating device is connected to the inspection apparatus 18, and the measurement pressure P1 and the detection pressure P2 are inputted to the calculating device to calculate the above-mentioned equation, the $V_F$ can be found immediately. Moreover, if the calculating device is designed to make a judgment as to whether the $V_F$ is defective or not, and the electromagnetic valve of the elimination tube 84 is activated on the basis of the judgment result, it is possible to easily and surely remove the filter cigarettes FT recognized to have defects in the $V_F$ thereof.

Figure 9:
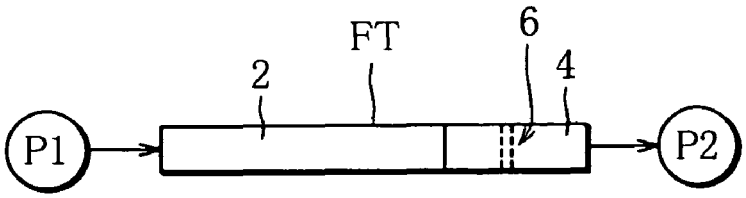
FIG. 9 is a schematic depiction of total ventilation measurement in a conventional dilution inspection apparatus.
Figure 10:
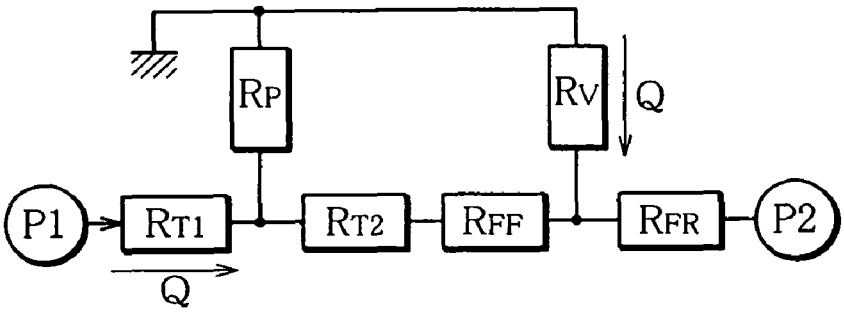
FIG. 10 is a diagram showing an analogy model of the total ventilation measurement of FIG. 9.

FIG. 9 diagrammatically shows a measurement principle of dilution performed by a conventional inspection apparatus. FIG. 10 shows an analogy model thereof, and based on this, the following equation is established according to the ratio between the measurement pressure P1 supplied to the cigarette end and the detection pressure P2 taken out from the filter end.

[Equation 2]

$$\frac{P1 - P2}{P1} = \frac{R_P(R_{T1} + R_{T2} + R_{FF}) + R_{T1}(R_{T2} + R_{FF} + R_V)}{R_P(R_{T1} + R_{T2} + R_{FF} + R_V) + R_{T1}(R_{T2} + R_{FF} + R_V)} \quad (2)$$

The right side of Equation (2) is identical to a resistance equation (Equation (5)) of $V_T$ in an after-mentioned measurement standard. This proves that the measurement principle is to find total ventilation $V_T$ of the filter cigarette FT. The total ventilation $V_T$ is as mentioned above the ratio of the air amount flowing in from the wrapping paper and the perforation line to the amount of smoke drawn by the smoker.

As in the above-mentioned Equation (1), $R_{T1}$, $R_{T2}$, $R_{FF}$, $R_{FR}$, $R_P$ and $R_V$ represent the equivalent resistance of the cigarette end side and filter end side of the cigarette 2, the equivalent resistance of the cigarette side and filter side of the filter 4, the equivalent resistance of the wrapping paper and tip paper, respectively.

Although in the cigarette manufacturing industry, the $V_F$, not $V_T$, is generally used as an alternative control target of nicotine and tar, the $V_F$ and the $V_T$ do not always have a fixed relationship. It is therefore difficult to accurately estimate the $V_F$ on the basis of the $V_T$. For this reason, this conventional method is not capable of estimating (predicting) a correct $V_F$, and is not suitable for control of the nicotine and tar of cigarettes.

Figure 11:
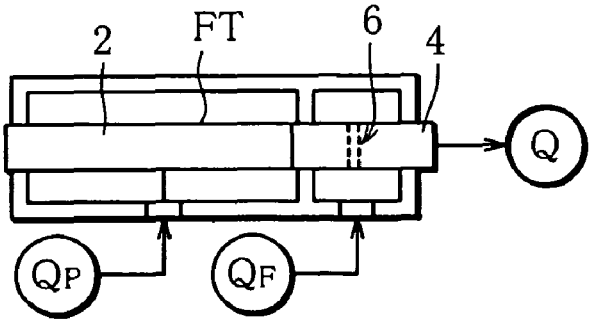
FIG. 11 is a schematic depiction of filter ventilation measurement using a measurement standard.

FIG. 11 diagrammatically shows a measurement standard (which is compliant with ISO) that is commonly used in the cigarette manufacturing industry to measure the $V_F$ and the wrapping paper ventilation $V_P$. The measurement using this measurement standard is carried out off-machine with respect to a sampled filter cigarette FT. Characters shown in FIG. 11 denote the following matters.

$Q_P$: Air amount flowing into the chamber surrounding the cigarette 2.

$Q_F$: Air amount flowing into the chamber surrounding the filter 4.

Q: Air amount flowing out from the filter end face.

Figure 12:
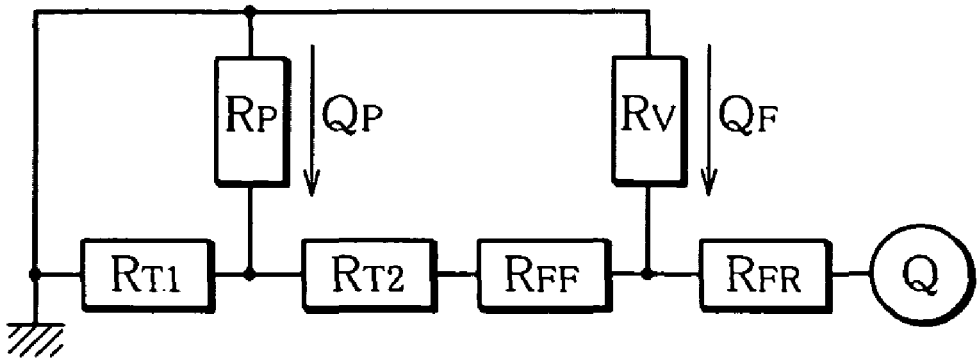
FIG. 12 is a diagram showing an analogy model of the filter ventilation measurement of FIG. 11.

According to this method, the air amounts $Q_P$, $Q_F$, and Q can be measured in a state where negative pressure is supplied to the filter end face of the filter cigarette FT. FIG. 12 shows an analogy model of this measuring method. Based on the measured air amounts $Q_P$, $Q_F$, and Q, resistance equations (Equations (3), (4) and (5)) of $V_F$, $V_P$ and $V_T$ can be found.

[Equation 3]

$$V_F = \frac{Q_F}{Q} = \frac{R_P(R_{T1} + R_{T2} + R_{FF}) + R_{T1}(R_{T2} + R_{FF})}{R_P(R_{T1} + R_{T2} + R_{FF} + R_V) + R_{T1}(R_{T2} + R_{FF} + R_V)} \quad (3)$$

$$V_P = \frac{Q_P}{Q} = \frac{R_{T1} \cdot R_V}{R_P(R_{T1} + R_{T2} + R_{FF} + R_V) + R_{T1}(R_{T2} + R_{FF} + R_V)} \quad (4)$$

$$V_T = V_F + V_P = \frac{Q_F + Q_P}{Q} = \frac{R_P(R_{T1} + R_{T2} + R_{FF}) + R_{T1}(R_{T2} + R_{FF} + R_V)}{R_P(R_{T1} + R_{T2} + R_{FF} + R_V) + R_{T1}(R_{T2} + R_{FF} + R_V)} \quad (5)$$

As in the above-mentioned Equations (1) and (2), $R_{T1}$, $R_{T2}$, $R_{FF}$, $R_{FR}$, $R_P$ and $R_V$ represent the equivalent resistance of the cigarette end side and filter side of the cigarette 2, the equivalent resistance of the cigarette side and filter end side of the filter 4, the equivalent resistance of the wrapping paper and tip paper, respectively.

The measuring method of the $V_F$ using the above measurement standard, however, is performed off-machine, and moreover the method measures a flow ratio $Q_F/Q$. Therefore, this measuring method requires a long period of time (0.1 second or more) as shown in FIG. 13 to gain a stable measurement result in respect of the $V_F$.

By contrast, the inspection apparatus 18 that measures the pressure ratio P2/P1 is capable of finding a highly accurate $V_F$ in a short period time (about 5 ms), thereby actualizing the high-speed measurement of the $V_F$. Consequently, the inspection apparatus 18 having such high-speed response can be applied to the filter attachment 10, and is capable of inspecting the $V_F$ with respect to all the filter cigarettes FT manufactured by using the filter attachment. In other words, the apparatus 18 is capable of performing continuous measurement of the $V_F$ on-machine.

Figure 13:
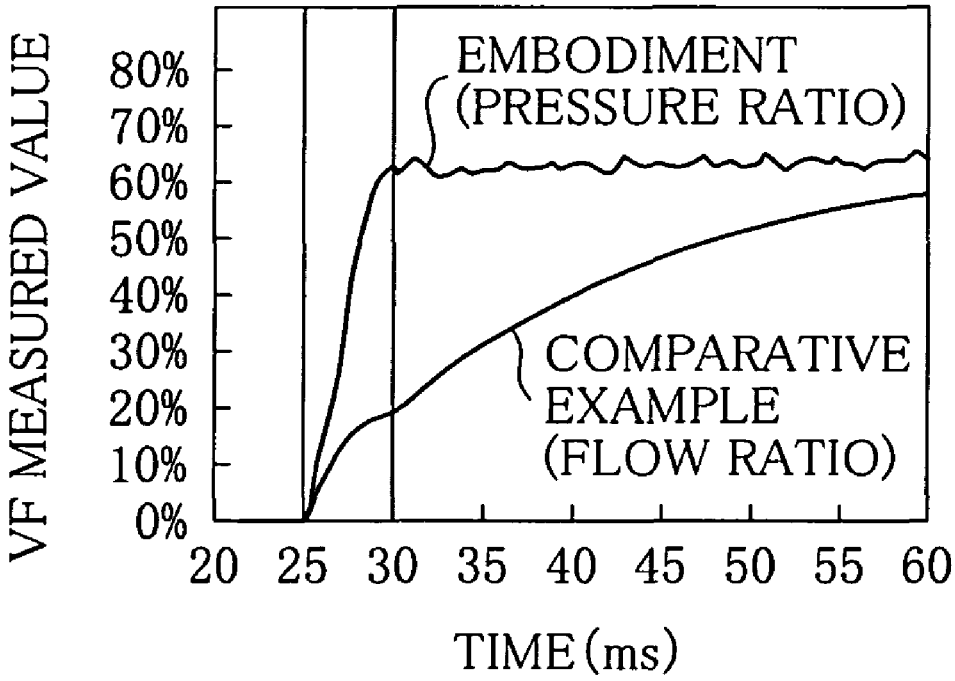
FIG. 13 is a graph showing response speed in the filter ventilation measurement of FIGS. 7 and 11.

FIG. 13 shows a measurement result in respect of a filter cigarette FT in which the value of $V_F$ is about 60 percent. As to the flow ratio measurement, a flow ratio Q is measured by using a sonic velocity nozzle, and a flow rate $Q_F$ is measured by a differential pressure method using an orifice of $\phi$1.2.

Figure 14:
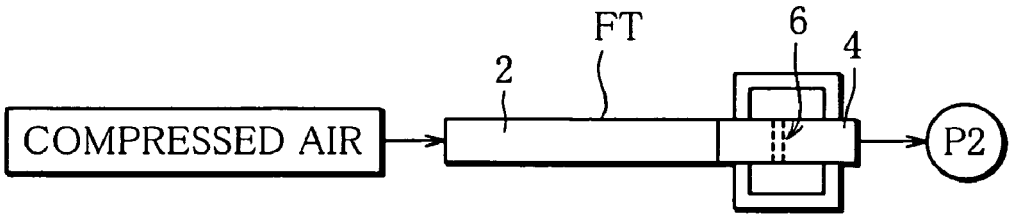
FIG. 14 is a schematic depiction of an inspection of holes in wrapping paper, which is carried out by the dilution inspection apparatus of FIG. 2.

FIG. 14 diagrammatically shows the measurement carried out in the rotation angle region VP in the inspection apparatus 18. According to this measurement, the outer circumferential surface of the filter 4 of the filter cigarette FT is in a closed position due to the surrounding chamber SC, so that the degree of $V_P$ can be judged on the basis of the detection pressure P3 in the state where the perforation line of the filter is virtually closed. Accordingly this measuring method is capable of making a reliable judgment as to occurrences of undesired tears and holes in the wrapping paper of the cigarette 2 even if the $V_F$ of the filter cigarette FT is great, that is to say, regardless of the $V_F$.

Figure 15:
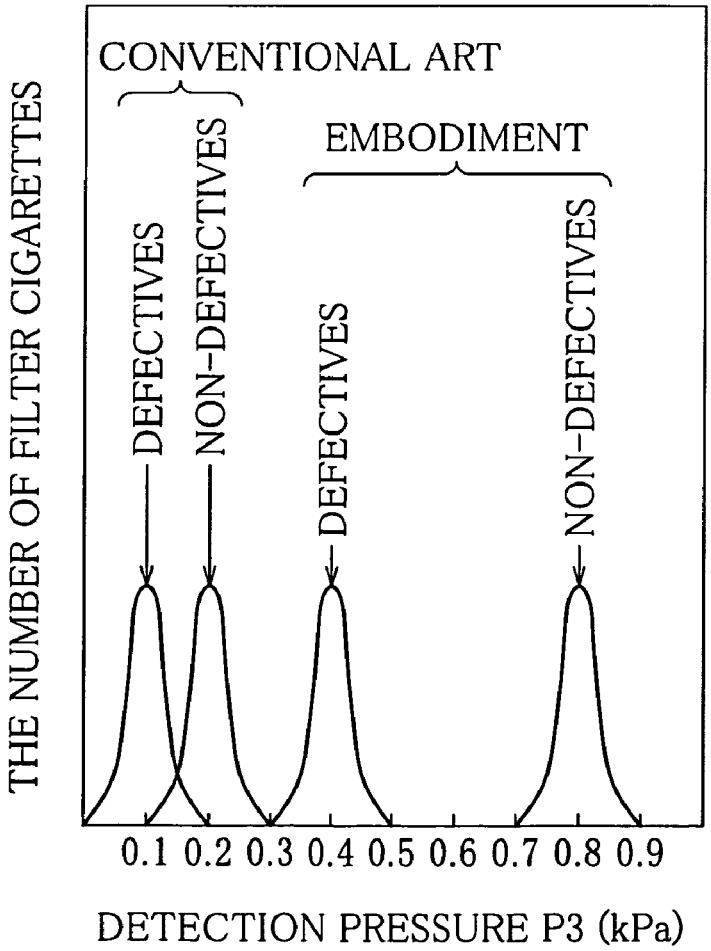
FIG. 15 is a histogram of detection pressure in case that the inspection of holes in wrapping paper of FIG. 14 and a conventional inspection of holes are applied to non-defective and defective articles.

For example, FIG. 15 shows in the form of a histogram a measurement result of the detection pressure P3, which was gained by a conventional measuring method in which the outer circumferential surface of the filter 4 was not blocked off, and a measurement result of the detection pressure P3, which was gained by the above-described embodiment, with respect to defective filter cigarettes FT in which holes were intentionally made in wrapping paper, and non-defective filter cigarettes FT.

It should be noted, however, that the $V_F$ of defective and non-defective filter cigarettes FT was 68 percent. Moreover, the compressed air pressure that was supplied was 1 kPa, and each hole formed in the wrapping paper of the defectives has a diameter of 1 mm.

As is apparent from FIG. 15, according to the measuring method using the inspection apparatus 18, distributions of the detection pressures of the non-defectives and defectives are completely separated, which makes it possible to reliably detect the defectiveness of the filter cigarettes FT. As a consequence, defective filter cigarettes FT are surely removed if the calculating device is further designed to make the defective/non-defective judgment.

In contrast, according to the conventional measuring method, the perforation line 6 of the filter 4 is not blocked up, so that the compressed air leaks outside the filter cigarette FT through the perforation line 6. As a result, the detection pressure P3 is reduced in accordance with the $V_F$. Therefore, in the case of the filter cigarette FT having large $V_F$, the difference of the detection pressure P3 between the defectives and the non-defectives is small, and it is difficult to detect defectives by the conventional method.

The present invention is not limited to the above-described one embodiment, and various modifications can be made. For example, as to the dilution inspection apparatus, the step of measuring the $V_F$ and that of detecting the defectives attributable to tears and holes in wrapping paper may be carried out in reverse order.

In the one embodiment, the filter cigarette FT is sucked and held in the transport groove 70 in the rotation angle region $\theta$4. In order to improve accuracy in measuring the $V_F$ and accuracy in detecting tears in wrapping paper, however, the suction may be cancelled in the rotation angle region $\theta$4. In other words, it is possible to improve the measurement accuracy, etc. by carrying out the measurement in further faithful accordance with the analogy. To that end, for example, the suction groove 60 may be discontinued in whole length of the rotation angle region $\theta$4. Again in this case, the filter cigarette FT is securely held on the transport groove 70 in the rotation angle region $\theta$4 not by suction but by the assembly 86.

Although the material of the rubber ring is silicone rubber, the material is not particularly limited and may be arbitrarily selected from natural rubber, synthetic rubber, gelatinous materials, etc. It is also possible to enhance the adhesion of the rubber ring with respect to the outer circumferential surface of the cigarette and upgrade the sealing ability by forming a slit in the inner circumferential surface of the rubber ring. Furthermore, in the assembly 86 on the filter side, the amount of decreasing the diameter of the rubber ring 134 may be fixed to the same as the rubber ring 135 by making the rubber ring 134 softer than the rubber ring 135.

The present invention is applied to the filter cigarettes having ventilation areas for directing outside air to the filters. Needless to say, however, the arrangement of the perforation lines as ventilation areas is not particularly limited, and the invention may be applied to various rod-like articles that require the dilution inspection, other than the above-mentioned filter cigarettes. The number of surrounding chambers that surround the outer circumferential surface thereof is not limited to one, and a plurality of surrounding chambers may be arranged along the axial direction thereof. The transport path for rod-like articles may be something other than the drum, and the reciprocation mechanism of the assembly and the compression mechanism of the rubber ring are not limited to those illustrated in the drawings. For example, it is also possible to form two adjacent assemblies integrally in the circumferential direction of the drum shell 64 and cause the assemblies to reciprocate at the same time.

The invention claimed is:

1. An inspection apparatus for a filter cigarette having a cigarette, a filter connected to the cigarette and having a mouthpiece end, and a ventilation area in an outer circumferential surface of the filter for introducing outside air, comprising:

a transport path for transporting said filter cigarette in a direction orthogonal to an axial direction of said filter cigarette, said transport path having an inspection position defined therein;

a filter socket assembly disposed on one side of said transport path and allowed to be connected to said filter cigarette when said filter cigarette passes through said inspection position, said filter socket assembly including:

a socket capable of receiving said filter and defining in the inside thereof a first airtight chamber for enclosing the mouthpiece end of the filter and a second airtight chamber for enclosing the outer circumferential surface of the filter including the ventilation area, a pair of elastically deformable rubber rings disposed in said socket to be separated from each other in an axial direction thereof, inner diameters of said rubber rings being reduced when said rubber rings are compressed in the axial direction thereof so that said rubber rings come into contact with the filter and partition the first airtight chamber and the second airtight chamber, a lateral input path for supplying the second airtight chamber of said socket with a compressed fluid of a given pressure;

an output path that outputs a pressure in the first airtight chamber;

a pressure sensor for detecting the pressure outputted from said output path; and reciprocating means for reciprocating said filter socket assembly toward said filter cigarette in order to receive the filter in said socket removably, wherein the reciprocating means includes a movable member for moving, through the rubber rings, the socket from a rest position toward an actuated position, and the socket receives the filter therein when positioned at the actuated position, wherein said filter socket assembly further includes compression means for mechanically compressing the rubber rings, the compression means having a stopper arranged at the actuated position for preventing movement of the socket but permitting further movement of the movable member, and wherein, after the socket is stopped at the actuated position by the stopper, the rubber rings are mechanically compressed by the further movement of the movable member.

2. The inspection apparatus according to claim 1, further comprising:

a cigarette socket assembly disposed on the other side of said transport path and allowed to be connected to said filter cigarette when said filter cigarette passes through said inspection position, said cigarette socket assembly including:

a cigarette socket capable of receiving a tip end of the cigarette and defining a third airtight chamber for enclosing the tip end of the cigarette in the inside thereof, and a forward input path for supplying the third airtight chamber of said cigarette socket with a compressed fluid of a given pressure when the second airtight chamber is in a fluidically closed state; said apparatus wherein:

said lateral input path of said filter cigarette assembly is blocked off while the third airtight chamber is supplied with the compressed fluid.

3. The inspection apparatus according to claim 2, further comprising:

a rotatable drum provided with each of said socket assemblies and including an outer circumferential surface defining said transport path.

4. An inspection method for a filter cigarette having a cigarette, a filter connected to the cigarette and having a mouthpiece end, and a ventilation area in an outer circumferential surface of said filter for introducing outside air, comprising the steps of:

forming a first airtight chamber for enclosing the mouthpiece end of the filter;

forming a second airtight chamber for enclosing the outer circumferential surface of the filter including said ventilation area; and measuring a pressure in the first airtight chamber when the second airtight chamber is supplied with a compressed fluid of a given pressure, wherein the first airtight chamber and the second airtight chamber are defined with use of a pair of deformable rubber rings, and inner diameters of the rubber rings are individually reduced when the rubber rings are mechanically compressed in an axial direction thereof so that the rubber rings individually airtightly contact the outer circumferential surface of the filter, wherein the first airtight chamber and the second airtight chamber are individually formed inside the socket when the socket is moved to an actuated position from a rest position, wherein the socket is moved from the rest position toward the actuated position by a movable member through the rubber rings, and wherein, after the socket is stopped at the actuated position, the rubber rings are mechanically compressed by further movement of the movable member.

5. The inspection method according to claim 4, wherein:

said method is carried out in a process where said filter cigarette is transported in a direction orthogonal to an axial direction thereof.

6. An inspection method for a filter cigarette having a cigarette, a filter connected to the cigarette and having a mouthpiece end, and a ventilation area in an outer circumferential surface of the filter for introducing outside air, comprising the steps of:

forming a first airtight chamber for enclosing the mouthpiece end of the filter;

forming a second airtight chamber for enclosing the outer circumferential surface of the filter including said ventilation area;

forming a third airtight chamber for enclosing a tip end of the cigarette; and measuring a pressure in the first airtight chamber when the third airtight chamber is supplied with a compressed fluid of a given pressure, wherein the first airtight chamber and the second airtight chamber are defined with use of a pair of deformable rubber rings, and inner diameters of the rubber rings are individually reduced when the rubber rings are mechanically compressed in an axial direction thereof so that the rubber rings individually airtightly contact the outer circumferential surface of the filter, wherein the first airtight chamber and the second airtight chamber are individually formed inside the socket when the socket is moved to an actuated position from a rest position, wherein the socket is moved from the rest position toward the actuated position by a movable member through the rubber rings, and wherein, after the socket is stopped at the actuated position, the rubber rings are mechanically compressed by further movement of the movable member.

7. The inspection method according to claim 6, wherein:

said method is carried out in a process where said filter cigarette is transported in a direction orthogonal to an axial direction thereof.

* * * * *